US009378622B2

(12) United States Patent
Tarantino

(10) Patent No.: US 9,378,622 B2
(45) Date of Patent: Jun. 28, 2016

(54) GAMING DEVICES WITH DEDICATED PLAYER RNG AND TIME SHARE FEATURES

(71) Applicant: Tipping Point Group, LLC, Las Vegas, NV (US)

(72) Inventor: Elia Rocco Tarantino, Las Vegas, NV (US)

(73) Assignee: Tipping Point Group, LLC, Las Vegas, NV (US)

( * ) Notice: Subject to any disclaimer, the term of this patent is extended or adjusted under 35 U.S.C. 154(b) by 0 days.

(21) Appl. No.: 14/574,831

(22) Filed: Dec. 18, 2014

(65) Prior Publication Data

US 2015/0170456 A1 Jun. 18, 2015

Related U.S. Application Data

(63) Continuation of application No. 14/019,091, filed on Sep. 5, 2013, now Pat. No. 8,932,130, which is a continuation of application No. 13/207,300, filed on Aug. 10, 2011, now Pat. No. 8,529,328, which is a continuation-in-part of application No. 13/047,262, filed on Mar. 14, 2011, now Pat. No. 8,529,342.

(51) Int. Cl.
*G07F 17/32* (2006.01)
*G07C 15/00* (2006.01)

(52) U.S. Cl.
CPC ..... *G07F 17/326* (2013.01); *G07F 17/3248* (2013.01); *G07F 17/3286* (2013.01); *G07C 15/006* (2013.01)

(58) Field of Classification Search
USPC ..... 463/22, 16, 29
See application file for complete search history.

(56) References Cited

U.S. PATENT DOCUMENTS 4,004,097 A 1/1977 Spaulding
4,261,012 A 4/1981 Maloomian (Continued)

FOREIGN PATENT DOCUMENTS

EP 0946028 9/1999
WO 02/055163 7/2002

(Continued)

OTHER PUBLICATIONS

PCT "Notification of Transmittal of the International Search Report and the Written Opinion of the International Searching Authority, or the Declaration for PCT/US2012/028866," mailed Nov. 1, 2012.

(Continued)

*Primary Examiner* — Pierre E Elisca
(74) *Attorney, Agent, or Firm* — Weide & Miller, Ltd.

(57) ABSTRACT

Gaming machines or devices utilize the output of random number generators (RNGs) in the presentation of games, wherein one or more of the RNGs are each assigned to a single player. Each uniquely assigned RNG is used to determine the outcome of the games played only by the assigned player, such as a casino gaming machine or a game board devices accessed via a remote presentation device such as a phone or computer. An RNG may also be stopped or paused and then restarted, whereby a sequence of random data remains continuous or contiguous relative to a number of games played, such as by the single player to which the RNG is assigned. Multiple players may also time-share a gaming machine in a manner whereby the gaming machine acts as a unique device to each player.

13 Claims, 6 Drawing Sheets

(56) References Cited

U.S. PATENT DOCUMENTS 4,357,624 A 11/1982 Greenberg
4,365,810 A 12/1982 Richardson
4,503,429 A 3/1985 Schreiber
4,521,014 A 6/1985 Sitrick
4,527,798 A 7/1985 Siekierski et al.
4,694,490 A 9/1987 Harvey et al.
4,704,725 A 11/1987 Harvey et al.
4,710,873 A 12/1987 Breslow et al.
4,743,002 A 5/1988 Menzel
4,743,022 A 5/1988 Wood
4,848,771 A 7/1989 Richardson
4,926,327 A 5/1990 Sidley
4,965,825 A 10/1990 Harvey et al.
5,007,649 A 4/1991 Richardson
5,105,184 A 4/1992 Pirani et al.
5,233,423 A 8/1993 Jernigan et al.
5,429,631 A 7/1995 Grenier
5,470,079 A 11/1995 LeStrange et al.
5,477,952 A 12/1995 Castellano et al.
5,531,441 A 7/1996 Dabrowski et al.
5,553,864 A 9/1996 Sitrick
5,559,312 A 9/1996 Lucero
5,586,936 A 12/1996 Bennett et al.
5,613,912 A 3/1997 Slater
5,655,961 A 8/1997 Acres et al.
5,678,679 A 10/1997 Berman
5,740,549 A 4/1998 Reilly et al.
5,761,647 A 6/1998 Boushy
5,774,873 A 6/1998 Berent et al.
5,785,592 A 7/1998 Jacobsen
5,813,912 A 9/1998 Shultz
5,816,918 A 10/1998 Kelly et al.
5,830,065 A 11/1998 Sitrick
5,851,149 A 12/1998 Xidos et al.
5,887,243 A 3/1999 Harvey et al.
5,907,321 A 5/1999 Grossman et al.
5,919,090 A 7/1999 Mothwurf
5,941,772 A 8/1999 Paige
5,971,271 A 10/1999 Wynn et al.
5,990,927 A 11/1999 Hendricks et al.
6,003,013 A 12/1999 Boushy et al.
6,012,832 A 1/2000 Saunders et al.
6,015,344 A 1/2000 Kelly et al.
6,049,823 A 4/2000 Hwang
6,068,552 A 5/2000 Walker et al.
6,089,975 A 7/2000 Dunn
6,113,495 A 9/2000 Walker et al.
6,142,876 A 11/2000 Cumbers
6,175,358 B1 1/2001 Scott-Jackson et al.
6,186,893 B1 2/2001 Walker et al.
6,203,428 B1 3/2001 Giobbi et al.
6,234,900 B1 5/2001 Cumbers
6,244,957 B1 6/2001 Walker et al.
6,251,014 B1 6/2001 Stockdale et al.
6,253,119 B1 6/2001 Dabrowski
6,263,258 B1 7/2001 Dabrowski
6,280,318 B1 8/2001 Criss-Puszkiewicz et al.
6,280,326 B1 8/2001 Saunders
6,302,793 B1 10/2001 Fertitta, III et al.
6,315,666 B1 11/2001 Mastera et al.
6,368,216 B1 4/2002 Hedrick et al.
6,368,218 B2 4/2002 Angell, Jr.
6,375,567 B1 4/2002 Acres
6,379,246 B1 4/2002 Dabrowski
6,379,247 B1 4/2002 Walker et al.
6,390,917 B1 5/2002 Walker et al.
6,409,602 B1 6/2002 Wiltshire et al.
6,425,825 B1 7/2002 Sitrick
6,443,456 B1 9/2002 Gajor
6,459,440 B1 10/2002 Monnes et al.
6,460,848 B1 10/2002 Soltys et al.
6,500,067 B1 12/2002 Luciano et al.
6,503,147 B1 1/2003 Stockdale et al.
6,508,710 B1 1/2003 Paravia et al.
6,517,435 B2 2/2003 Soltys et al.
6,517,436 B2 2/2003 Soltys et al.
6,520,857 B2 2/2003 Soltys et al.
6,527,271 B2 3/2003 Soltys et al.
6,530,836 B2 3/2003 Soltys et al.
6,530,837 B2 3/2003 Soltys et al.
6,533,276 B2 3/2003 Soltys et al.
6,533,662 B2 3/2003 Soltys et al.
6,540,609 B1 4/2003 Paige
6,579,179 B2 6/2003 Poole et al.
6,579,180 B2 6/2003 Soltys et al.
6,579,181 B2 6/2003 Soltys et al.
6,582,310 B1 6/2003 Walker et al.
6,592,456 B2 7/2003 Walker et al.
6,595,857 B2 7/2003 Soltys et al.
6,598,788 B1 7/2003 Dabrowski
6,620,046 B2 9/2003 Rowe
6,638,163 B2 10/2003 Moody
6,641,483 B1 11/2003 Luciano et al.
6,645,068 B1 11/2003 Kelly et al.
6,648,757 B1 11/2003 Slomiany et al.
6,652,378 B2 11/2003 Cannon et al.
6,652,380 B1 11/2003 Luciano
6,663,490 B2 12/2003 Soltys et al.
6,672,589 B1 1/2004 Lemke et al.
6,676,515 B1 1/2004 Baltz et al.
6,679,775 B1 1/2004 Luciano et al.
6,682,421 B1 1/2004 Rowe et al.
6,682,423 B2 1/2004 Brosnan et al.
6,685,559 B2 2/2004 Luciano et al.
6,712,696 B2 3/2004 Soltys et al.
6,712,698 B2 3/2004 Paulsen et al.
6,722,978 B2 4/2004 Valenti
6,729,956 B2 5/2004 Wolf et al.
6,743,095 B2 6/2004 Cole et al.
6,749,510 B2 6/2004 Giobbi
6,758,751 B2 7/2004 Soltys et al.
6,800,029 B2 10/2004 Rowe et al.
6,843,723 B2 1/2005 Joshi
6,846,238 B2 1/2005 Wells
6,848,995 B1 2/2005 Walker et al.
6,852,029 B2 2/2005 Baltz et al.
6,863,611 B1 3/2005 Marrow et al.
6,884,174 B2 4/2005 Lundy et al.
6,890,256 B2 5/2005 Walker et al.
6,896,618 B2 5/2005 Benoy et al.
6,908,384 B1 6/2005 Luciano, Jr.
6,916,246 B1 7/2005 Luciano, Jr.
6,924,903 B2 8/2005 Brooks et al.
6,935,946 B2 8/2005 Yoseloff et al.
6,942,574 B1 9/2005 LeMay et al.
6,958,014 B1 10/2005 Luciano, Jr. et al.
6,984,147 B2 1/2006 Tricaud et al.
6,991,543 B2 1/2006 Joshi
7,004,837 B1 2/2006 Crowder, Jr. et al.
7,022,017 B1 4/2006 Halbritter et al.
7,025,676 B2 4/2006 Cole et al.
7,063,617 B2 6/2006 Brosnan et al.
7,070,503 B2 7/2006 Rudolph
7,094,149 B2 8/2006 Walker et al.
7,112,138 B2 9/2006 Hedrick et al.
7,118,478 B2 10/2006 Fayter et al.
7,137,889 B1 11/2006 Luciano, Jr.
7,137,892 B2 11/2006 Sitrick
7,241,219 B2 7/2007 Walker et al.
7,255,351 B2 8/2007 Yoseloff et al.
7,285,049 B1 10/2007 Luciano, Jr. et al.
7,290,072 B2 10/2007 Quraishi et al.
7,297,062 B2 11/2007 Gatto et al.
7,322,885 B1 1/2008 Luciano, Jr. et al.
7,357,714 B2 4/2008 Tessmer et al.
7,392,470 B2 6/2008 Kammler
7,413,513 B2 8/2008 Nguyen et al.
7,473,179 B2 1/2009 Xidos et al.
7,512,235 B2 3/2009 Multerer et al.
7,520,810 B2 4/2009 Dabrowski
7,588,495 B2 9/2009 Walker et al.
7,674,177 B2 3/2010 Cole
7,699,703 B2 4/2010 Muir et al.
7,704,147 B2 4/2010 Quraishi et al.

(56) References Cited

U.S. PATENT DOCUMENTS 7,727,060 B2 6/2010 Mills
7,771,271 B2 8/2010 Walker et al.
7,819,750 B2 10/2010 Lam et al.
7,827,488 B2 11/2010 Sitrick
7,867,086 B2 1/2011 Sitrick
7,877,798 B2 1/2011 Saunders et al.
8,012,015 B2 9/2011 Alderucci
8,043,152 B2 * 10/2011 Walker ..... G07F 17/32 463/16
8,133,102 B2 3/2012 Dabrowski
8,932,130 B2 1/2015 Tarantino
2002/0016202 A1 2/2002 Fertitta, III et al.
2002/0025850 A1 2/2002 Hafezi
2002/0128057 A1 9/2002 Walker et al.
2002/0142841 A1 10/2002 Boushy
2002/0147047 A1 10/2002 Letovsky et al.
2002/0155873 A1 10/2002 Berman et al.
2002/0155891 A1 10/2002 Okada et al.
2002/0169021 A1 11/2002 Urie et al.
2002/0177479 A1 11/2002 Walker et al.
2002/0177480 A1 11/2002 Rowe
2002/0198044 A1 12/2002 Walker et al.
2003/0004871 A1 1/2003 Rowe
2003/0013512 A1 1/2003 Rowe
2003/0013513 A1 1/2003 Rowe
2003/0013516 A1 1/2003 Walker et al.
2003/0013527 A1 1/2003 Rowe et al.
2003/0027631 A1 2/2003 Hedrick et al.
2003/0032474 A1 2/2003 Kaminkow
2003/0032481 A1 2/2003 Pfeiffer et al.
2003/0036425 A1 2/2003 Kaminkow et al.
2003/0054868 A1 3/2003 Paulsen et al.
2003/0054880 A1 3/2003 Lam et al.
2003/0054881 A1 3/2003 Hedrick et al.
2003/0064800 A1 4/2003 Jackson et al.
2003/0083943 A1 5/2003 Adams et al.
2003/0096645 A1 5/2003 Soltys et al.
2003/0100359 A1 5/2003 Loose et al.
2003/0119579 A1 6/2003 Walker et al.
2003/0139214 A1 7/2003 Wolf et al.
2003/0149619 A1 8/2003 Stanley et al.
2003/0162588 A1 8/2003 Brosnan et al.
2003/0187736 A1 10/2003 Teague et al.
2003/0195036 A1 10/2003 Poole et al.
2003/0207711 A1 11/2003 Rowe
2003/0216169 A1 11/2003 Walker et al.
2003/0216966 A1 11/2003 Saenz et al.
2003/0232647 A1 12/2003 Moser
2004/0024608 A1 2/2004 Saenz et al.
2004/0032086 A1 2/2004 Barragan
2004/0038735 A1 2/2004 Steil et al.
2004/0039679 A1 2/2004 Norton et al.
2004/0039695 A1 2/2004 Rowe
2004/0043814 A1 3/2004 Angell et al.
2004/0053663 A1 3/2004 Paulsen et al.
2004/0077408 A1 4/2004 D'Amico et al.
2004/0092303 A1 5/2004 George et al.
2004/0092315 A1 5/2004 Boyd et al.
2004/0106449 A1 6/2004 Walker et al.
2004/0113360 A1 6/2004 George et al.
2004/0127284 A1 7/2004 Walker et al.
2004/0132531 A1 7/2004 George et al.
2004/0132532 A1 7/2004 Brosnan et al.
2004/0142739 A1 7/2004 Loose et al.
2004/0143496 A1 7/2004 Saenz
2004/0209674 A1 10/2004 Conover et al.
2004/0214622 A1 10/2004 Atkinson
2004/0219975 A1 11/2004 Soltys et al.
2004/0254006 A1 12/2004 Lam et al.
2004/0254009 A1 12/2004 D'Amico et al.
2004/0254013 A1 12/2004 Quraishi et al.
2004/0254014 A1 12/2004 Quraishi et al.
2005/0003890 A1 1/2005 Hedrick et al.
2005/0009600 A1 1/2005 Rowe et al.
2005/0013527 A1 1/2005 Doyle et al.
2005/0014558 A1 1/2005 Estey
2005/0027381 A1 2/2005 George et al.
2005/0032575 A1 2/2005 Goforth et al.
2005/0037837 A1 2/2005 Rowe
2005/0037838 A1 2/2005 Dunaevsky et al.
2005/0054439 A1 3/2005 Rowe et al.
2005/0054446 A1 3/2005 Kammler et al.
2005/0059457 A1 3/2005 Rothschild et al.
2005/0059480 A1 3/2005 Soukup et al.
2005/0059485 A1 3/2005 Paulsen et al.
2005/0075165 A1 4/2005 George et al.
2005/0075889 A1 4/2005 Gomes et al.
2005/0085300 A1 4/2005 Johnson
2005/0096112 A1 5/2005 Guinn, Jr. et al.
2005/0096129 A1 5/2005 Walker et al.
2005/0119044 A1 6/2005 Lim et al.
2005/0119048 A1 6/2005 Soltys et al.
2005/0119052 A1 6/2005 Russell et al.
2005/0137011 A1 6/2005 Walker et al.
2005/0143166 A1 6/2005 Walker et al.
2005/0153768 A1 7/2005 Paulsen
2005/0153773 A1 7/2005 Nguyen et al.
2005/0170883 A1 8/2005 Muskin
2005/0170892 A1 8/2005 Atkinson
2005/0171808 A1 8/2005 Saenz et al.
2005/0182647 A1 8/2005 Saenz et al.
2005/0187012 A1 8/2005 Walker et al.
2005/0197183 A1 9/2005 Walker et al.
2005/0215310 A1 9/2005 Boyd et al.
2005/0215316 A1 9/2005 Rowe et al.
2006/0019747 A1 1/2006 Loose et al.
2006/0025206 A1 2/2006 Walker et al.
2006/0046819 A1 3/2006 Nguyen et al.
2006/0068906 A1 3/2006 Morrow et al.
2006/0073870 A1 4/2006 Cannon
2006/0084488 A1 4/2006 Kinsley et al.
2006/0084506 A1 * 4/2006 Yoseloff ..... G07F 17/32 463/42
2006/0135230 A1 6/2006 Godse et al.
2006/0135255 A1 6/2006 Roth
2006/0154719 A1 7/2006 Okuniewicz
2006/0154721 A1 7/2006 Okuniewicz
2006/0178208 A1 8/2006 Cole
2006/0211477 A1 9/2006 Walker et al.
2006/0227635 A1 10/2006 Walker et al.
2006/0227636 A1 * 10/2006 Walker ..... G07F 17/32 365/201
2006/0247027 A1 11/2006 Walker et al.
2006/0252504 A1 11/2006 Walker et al.
2006/0252505 A1 11/2006 Walker et al.
2006/0287063 A1 12/2006 Walker et al.
2006/0287067 A1 12/2006 White et al.
2007/0015569 A1 1/2007 Norton et al.
2007/0121936 A1 5/2007 Guillou et al.
2007/0129137 A1 6/2007 Walker et al.
2007/0205617 A1 9/2007 Hahn et al.
2007/0213124 A1 9/2007 Walker et al.
2007/0218968 A1 * 9/2007 Snow ..... A63F 1/00 463/13
2007/0259709 A1 11/2007 Kelly et al.
2007/0265060 A1 11/2007 Hornik et al.
2008/0009344 A1 1/2008 Graham et al.
2008/0026816 A1 1/2008 Sammon et al.
2008/0039190 A1 2/2008 Walker et al.
2008/0113807 A1 5/2008 Alderucci
2008/0254897 A1 10/2008 Saunders et al.
2009/0088240 A1 4/2009 Saunders et al.
2009/0088257 A1 4/2009 Saunders et al.
2009/0093311 A1 4/2009 Saunders et al.
2009/0093312 A1 4/2009 Carlson
2009/0291736 A1 11/2009 Walker et al.
2010/0075743 A1 3/2010 Yoshizawa
2010/0216534 A1 8/2010 Peck et al.
2012/0028695 A1 * 2/2012 Walker ..... G07F 17/32 463/16
2012/0238341 A1 9/2012 Tarantino

(56) References Cited

U.S. PATENT DOCUMENTS

| | | | |
|---|---|---|---|
| 2012/0238355 | A1 | 9/2012 | Tarantino |
| 2012/0276981 | A1 | 11/2012 | Weber et al. |
| 2013/0040728 | A1 | 2/2013 | Tarantino |

FOREIGN PATENT DOCUMENTS

| | | |
|---|---|---|
| WO | 03/089082 | 10/2003 |
| WO | 03/093986 | 11/2003 |
| WO | 2005/070509 | 4/2005 |
| WO | 2005/099839 | 10/2005 |
| WO | 2012/125604 | 9/2012 |
| WO | 2012/125607 | 9/2012 |
| WO | 2012/125630 | 9/2012 |

OTHER PUBLICATIONS

PCT "Notification of Transmittal of the International Search Report and the Written Opinion of the International Searching Authority, or the Declaration for PCT/US2012/028870," mailed Oct. 29, 2012.

PCT "Notification of Transmittal of the International Search Report and the Written Opinion of the International Searching Authority, or the Declaration for PCT/US2012/028917," mailed Nov. 1, 2012.

* cited by examiner

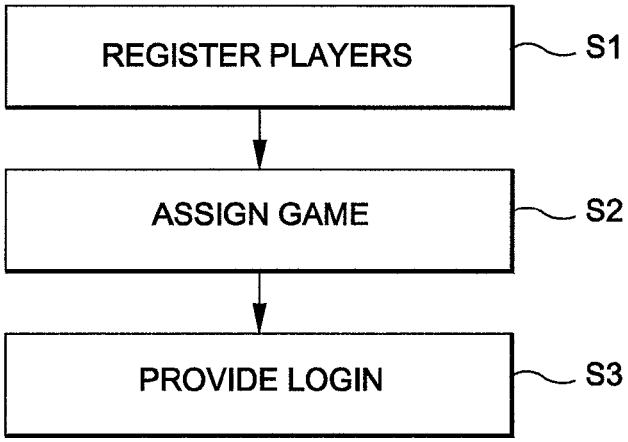
FIG. 6A
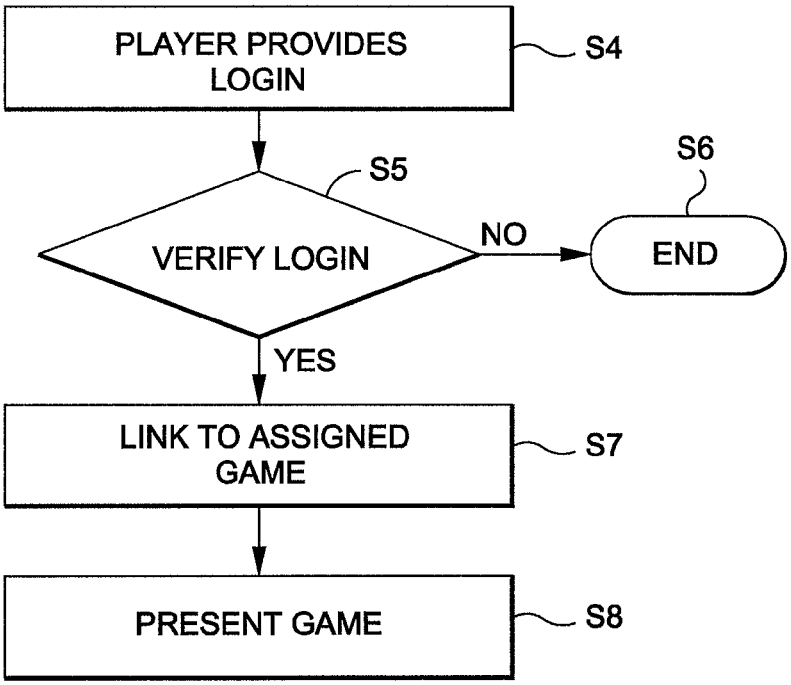
FIG. 6B
| PLAYER NAME | ID | PASSWORD | GAMING DEVICE |
|---|---|---|---|
| ROCCO TARANTIINO | RT4216 | LASVEGAS | 2XF7114GK21 |
| ⋮ | ⋮ | ⋮ | ⋮ |
FIG. 6C

GAMING DEVICES WITH DEDICATED PLAYER RNG AND TIME SHARE FEATURES

RELATED APPLICATION DATA

This application is a continuation of U.S. patent application Ser. No. 14/019,091, filed Sep. 5, 2013, which is a continuation of U.S. patent application Ser. No. 13/207,300, filed Aug. 10, 2011, which is a continuation-in-part of U.S. patent application Ser. No. 13/047,262, filed Mar. 14, 2011.

FIELD OF THE INVENTION

The present invention relates to gaming machines and devices and particularly to such machines or devices which present wagering games.

BACKGROUND OF THE INVENTION

Wager based gaming continues to grow in popularity. In order to meet player demand, gaming machine manufacturers continue to develop new games and gaming machines.

Originally, wager based games comprised physical card, dice and similar games played at tables, and mechanical slot machines having physical spinning reels bearing printed symbols. In recent years, gaming machines have been developed which incorporate the latest technologies such as electronic video displays and sound systems for presenting extreme graphics and sounds. These machines may present slot-type games via graphical representations of spinning reels on a video display. Likewise, gaming tables may employ video screens, electronic chip trackers and other technologies.

Despite the use of such new technologies, the premise of wager based gaming remains the same. A player places a wager and attempts to achieve a winning outcome of a game. If the outcome of the game is a winning outcome, the player is paid winnings. In some cases, such as in slot-type games, the outcome of the game is entirely random. In other games, such as poker games, the outcome may depend upon player input such as the selection of cards which are held or discarded when forming a poker hand.

While the outcomes of these games cannot be controlled by the player, players are generally superstitious and believe that "luck" has much to do with whether they win or lose. As such, as described in the Background of U.S. Pat. No. 7,699,703, players often believe that outside factors have an impact upon the probability of their winning games.

For example, a player may play a gaming machine and receive several winning outcomes. That player may believe that the gaming machine is "hot" and thus not want to leave that gaming machine. In particular, players often believe that if they leave a "hot" machine and another player plays the machine, the streak of wins may end, so that when the player returns, the gaming machine has been affected by the intervening player's play.

Many newer games offer a variety of features which may extend or relate to more than one game event. For example, progressive jackpots are common for wagering game play. A progressive jackpot is an award which grows over time, such as based upon game wagers or the number of games played. The progressive jackpot may be awarded to the player who receives a certain qualifying winning outcome.

As one example, a single gaming machine might have an associated progressive jackpot. The progressive jackpot might start at $1000.00. A player might play 50 wagering games at the machine without receiving the progressive jackpot winning outcome. During that time, the progressive jackpot might grow to $1500.00. Having played so many games without having yet triggered the progressive jackpot winning outcome, the player may believe that such an outcome is imminent. As a result, the player may not wish to leave the gaming machine for fear that another player will play the machine and be the one who receives the progressive jackpot winning outcome.

Other games may include similar features such as bonuses. As one example, a player might play games in which the player collects certain bonus symbols, such as described in U.S. Pat. No. 6,135,884 wherein a player may collect "cherry" symbols as they appear on slot reels. When the player has played a sufficient number of games to aggregate a predetermined number of bonus symbols, the player play be awarded a bonus award. As a result, the player may be reticent to leave a gaming machine after the player has a collected a large number of the symbols required for the bonus, knowing that another player might play the gaming machine and collect the few remaining required symbols and thus win the bonus.

SUMMARY OF THE INVENTION

Aspects of the invention comprise methods of playing and presenting games, and gaming machines and gaming systems configured to present games.

In one embodiment, a gaming system comprises one or more presentation devices, at least one gateway, and at least one gaming device. Each presentation device may be a dedicated/special purpose device or may be a general purpose device. Preferably, the presentation devices include at least one video display capable of displaying game information, at least one player input device, and at least one communication interface. A presentation device might comprise, for example, a desktop computer, a laptop computer, a cellular phone or a PDA.

The at least one gateway preferably comprises one or more devices which are configured to receive a request for game play by a player of a presentation device and selectively link that player to a gaming device. In a preferred embodiment, the gateway comprises one or more servers. In such an embodiment, the gateway might comprise a server which is configured as a computing device which has a processor for executing instructions, a memory for storing data such as instructions, and at least one communication interface for forming a communication link to both at least one presentation device and a gaming device.

The gaming device is preferably configured to generate game information, transmit game information, receive player input, and generate game outcomes. At one or more times the gaming device is in communication with the gateway, whereby the gaming device may receive information from the gateway and may transmit information to the gateway. In a preferred embodiment, the gaming device comprises a circuit board. Preferably, the gaming device does not have the attributes of a gaming machine. Namely, the gaming device is not directly playable, preferably lacking a display, player input device(s), coin or bill acceptors and other features of standard gaming machines which permit their direct play by a player.

In accordance with the invention, each gaming device is assigned to a unique player, whereby no other player may play the gaming device. The gateway or a device linked thereto may store player identification information such as a User ID and password. A player transmits identification information from their presentation device to the gateway for verification. If verified, a communication link is established through the gateway from the player's presentation device to the gaming device. In this manner, only the assigned player may access their assigned gaming device, even when the assigned player is not using their gaming device.

In one embodiment, a plurality of gaming devices may be linked to one or more gateways. For example, a casino may provide multiple gaming devices in one or more racks in a secure computing area.

The gaming devices and/or gateway may be linked to other devices or systems. For example, in a casino environment the casino may have multiple existing gaming machines on the casino floor. Those gaming machines may be linked to one or more existing player tracking, accounting, bonusing or other systems. The gaming devices and/or gateway may be linked to such devices or systems. For example, the gateway may be linked to an existing casino player tracking system. In this manner, a player's play of a traditional gaming machine on the floor of the casino may be tracked and aggregated with play by the player of their assigned gaming device.

In accordance with the invention, a player may play their assigned gaming device from a remote location. Such a location may be external to a casino (such as the player's home or office). As one aspect of the invention, a player's location may be verified, such as to establish that the player is in a jurisdiction which permits the player to engage in game play.

In a preferred embodiment, one or more of the games presented to a player by their assigned gaming device is a wagering game. The gateway or a linked accounting system may facilitate value transactions, such as wagering of credits, use of a value account or credit card or the like.

In one embodiment, a player may be assigned a gaming device by meeting certain criteria, such as minimum levels of play of traditional gaming machines at a casino. In other embodiments, a player might purchase a gaming device. When a player no longer wishes to play their gaming device, the operator may destroy it.

Various embodiments of the invention comprise methods for assigning a player a unique gaming device and permitting a player to access their gaming device and participate in one or more wagering games from their remote presentation device.

The invention has numerous advantages and benefits. One advantage is that each gaming device can be played by only its assigned player, even when the assigned player is not actively playing the gaming device. In this manner, a player's "good luck" or hot streak cannot be interfered with by an intervening player's play. In addition, because only the assigned player may play games via the gaming device, all of the assigned player's activities can be stored and are never affected by another player's play. For example, a player might stop play in the middle of a game and restart play at that exact same point at a later time. A player might also collect bonus symbols or the like, which symbols only inure to that player because no other player has access to the gaming device. Another advantage of the invention is that players are permitted to engage in game play to an assigned gaming device without taking an existing gaming machine on the casino floor out of service.

In accordance with another embodiment of the invention, a gaming machine, gaming device or gaming system includes multiple random number generators (RNGs) which each generate a sequence of random data, such as numerical values, used to determine game outcomes. One or more of the RNGs is each assigned to a single player. Each uniquely assigned RNG is used to determine the outcome of the games played only by the assigned player, such as games presented by casino gaming machines, the gaming devices herein, or via remote or mobile devices.

In a gaming system, the RNGs may be implemented by a server. A plurality of gaming machines or devices and/or game servers (such as to facilitate remote or mobile game play) are configured to access the RNGs of the server.

A player may identify themselves, such as by inputting or providing player identification information. Such information may be associated with a player tracking system which identifies individual players and their assigned RNGs. Once a player is identified, a gaming machine, gaming device or game server preferably utilizes the player's assigned RNG to present games to the player.

In accordance with the invention, an individual player may have a dedicated game RNG, whereby game results generated or determined by that RNG are unique to that player and are not shared by other players.

In another embodiment of the invention, an RNG may also be stopped or paused and then restarted. In one embodiment, the RNG may be stopped and restarted to cause a sequence of random data generated thereby to remain continuous or contiguous relative to a number of games played.

In a preferred embodiment, a RNG which is assigned to a player by be stopped and restarted. When the player stops playing a first game session, the assigned RNG stops or pauses. When the same player begins play of a second game session, the assigned RNG restarts. Preferably, the RNG stops at a first point in the data sequence and then restarts from the next point in the data sequence.

In accordance with yet another embodiment of the invention, a gaming machine or device may be shared by two or more players. In a preferred embodiment, the gaming machine or device may be utilized at different times by two or more players in a time-share configuration, and preferably in a manner that the gaming machine acts as a unique device to each player.

In one configuration, players may reserve time periods or intervals at one or more gaming machines or devices. During a reserved time period, a gaming machine or device may be locked from play by other than the player securing the reserved time.

A player having a reservation may be required to identify themselves, such as by using a player tracking card or other identification, or by using an access code, in order to access the gaming machine or device during the reserved time. During non-reserved times, the gaming machine or device may be available for public play.

Reservations may be implemented by a reservation system, such as via a reservation or player tracking server linked to one or more gaming machines or devices. A casino or other game operator may charge a player for a reservation, including varying the price depending upon various factors such as the time of day, length of reservation and/or particular gaming machine or device.

In a preferred embodiment, multiple players may play games via a single gaming machine or device, but in a manner where the gaming machine or device emulates or acts as a gaming machines or device which is unique to each player. In particular, in one embodiment, during a reserved period of game play, games presented by the gaming machine or device to the player may be presented utilizing the player's assigned RNG. In this manner, different players may utilize the same gaming machine or device during different time periods, wherein each player's play is unique or independent from the other players' play by virtue of each player's games being generated via their uniquely assigned RNG.

Further objects, features, and advantages of the present invention over the prior art will become apparent from the detailed description of the drawings which follows, when considered with the attached figures.

DESCRIPTION OF THE DRAWINGS

FIG. 6A is a flow diagram illustrating a player gaming device registration process;

FIG. 6B is a flow diagram illustrating a login and game play process;

FIG. 6C illustrates a player identification and gaming device assignment record in accordance with one aspect of the invention.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Embodiments of the invention comprise a gaming device, a gaming system having player-dedicated gaming devices, and a method of presenting wagering games. In a preferred embodiment of the invention, individual gaming devices are dedicated to individual players for play only by the assigned player. The gaming devices may comprise game boards which are accessible via a network, such as from a player's desktop or laptop computer, PDA or other presentation device.

In accordance with another embodiment of the invention gaming machines and gaming devices utilize player-assigned random number generators. In one embodiment, a unique random number generator is assigned to a single player. That random number generator is used to determine the outcome of the games played only by the assigned player.

In accordance with another embodiment of the invention, an RNG may be stopped or paused and then restarted, such as in relation to a player's stopping and re-starting of game play.

In accordance with yet another embodiment of the invention, a gaming machine or device may be shared by two or more players. In a preferred embodiment, the gaming machine or device may be utilized at different times by two or more players in a time-share configuration, and preferably in a manner that the gaming machine acts as a unique device to each player.

Figure 1:
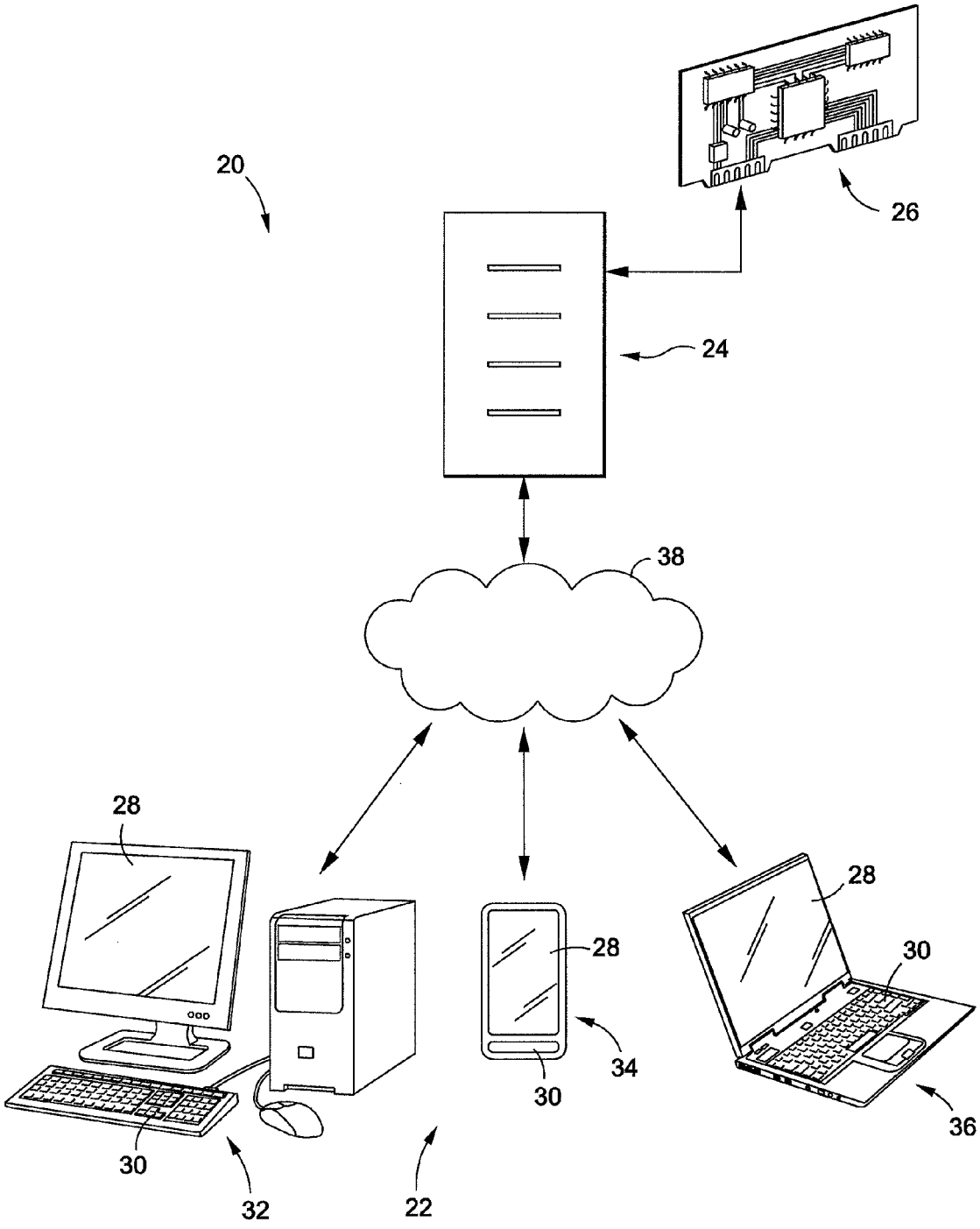
FIG. 1 illustrates a first embodiment system in accordance with the invention, the system including one or more presentation devices, at least one gateway and at least one gaming device.

As illustrated in FIG. 1, in one embodiment, a gaming system 20 comprises one or more presentation devices 22, at least one gateway 24, and at least one gaming device 26. The presentation devices 22 may be dedicated/special purpose devices or may be general purpose devices. Preferably, the presentation devices 22 include at least one video display 28 capable of displaying game information, at least one player input device 30, and at least one communication interface.

The presentation device 22 might comprise, for example, a desktop computer 32, a telephone (including cellular, wireless or wired telephones) or PDA 34 (such as an iPhone®), a laptop or notebook computer 36, or various other devices. As indicated, the presentation device 22 might also comprise a special purpose device such as a specially configured gaming tablet.

The player input device 30 might comprise, for example, a keyboard, mouse, joystick, touch-screen, button(s), trackballs or other devices now known or later configured and which are capable of receiving input from a player. The communication interface is preferably configured to permit information or data to be exchanged from one or more remote device or locations with the presentation device 22. The one or more communication interface might support wired or wireless communications using various protocols. For example, if the presentation device 22 is a PDA, the communications might be by 3G, 4G, IMT, GSM or the like. If the presentation device 22 is a desktop computer, the communications might be by TCP/IP or the like. Of course, other protocols may be used such as Bluetooth, 802.11xx and the like.

It will be appreciated that the presentation device 22 may include other components. For example, the presentation device 22 may include a main processor, a video and/or audio processor, input and output ports or the like.

The at least one gateway 24 is preferably one or more devices which are configured to receive a request for game play by a player of a presentation device 22 and selectively link that player to a gaming device 26. In a preferred embodiment, the gateway 24 comprises one or more servers. In such an embodiment, the gateway 24 might comprise a server which is configured as a computing device which has a processor for executing instructions, a memory for storing data such as instructions, and at least one communication interface for forming a communication link to both at least one presentation device 22 and a gaming device 26. In one embodiment, the gateway 24 might comprise or be in communication with one or more mass data storage devices, such as one or more hard drives or the like.

The gateway 24 might also include one or more user interface features. Such might comprise, for example, a user station which includes a video display and one or input devices (such as a keyboard, mouse or the like). Such a user station may permit an operator to interface with and manage or control the gateway 24, such as to change operator settings and the like.

It will be appreciated that the gateway 24 might comprise more than one device. For example, the gateway 24 might comprise a router and one or more separate computing devices. The functions of the various computing devices might be segregated. For example, one computing device might save and verify login information (as detailed below), while another might monitor game play via the gaming devices.

As described in more detail below, at one or more times a presentation device 22 and the gateway 24 are linked by a communication link between their communication interfaces. The type of communication link may vary, such as depending upon the particular type of presentation device 22 and/or the communication path or protocol which is utilized.

In one embodiment, the presentation device 22 and gateway 24 may communicate through at least one external network 38. Such a network might comprise the Internet, a cellular network, a satellite communication network or the like. Of course, the communication link might comprise a dedicated link, such as a dedicated wired link between the devices. Further, the communication link might comprise a number of local, wide area or other networks or pathways linked together. Such networks might be public and/or private.

The gaming device 26 is preferably configured to generate game information, transmit game information, receive player input, and generate game outcomes. As indicated above, the gaming device 26 is in communication with the gateway 24, whereby the gaming device 26 may receive information from the gateway 24 and may transmit information to the gateway 24.

Figure 2:
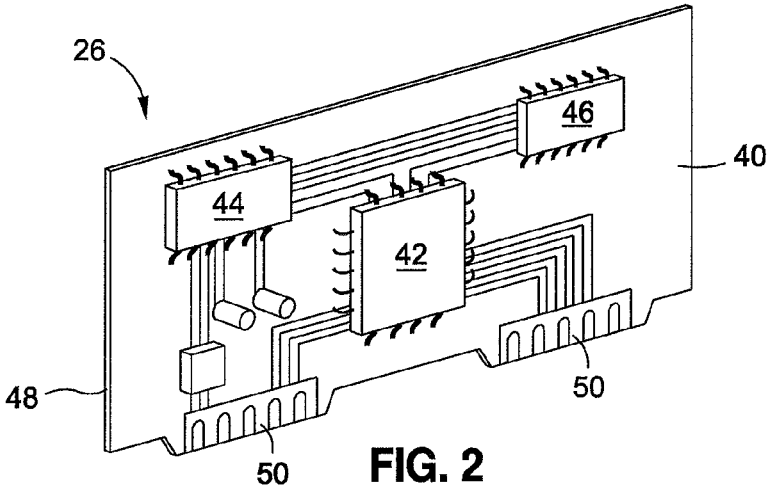
FIG. 2 illustrates a configuration of the invention in which a plurality of gaming devices are associated with at least one gateway.

A preferred embodiment of a gaming device 26 of the invention is illustrated in FIG. 2. In the preferred embodiment, the gaming device 26 comprises a circuit board. In such an embodiment, the gaming device 26 may have a base or substrate 40. Various components are supported by the substrate 40, such as by being attached thereto or imbedded therein.

As indicated, in a preferred embodiment the gaming device 26 is configured to generate game information. In one embodiment, the gaming device 26 comprises means for generating game data or information. Such means may comprise at least one processor 42. The processor 42 is configured generate game information, such as based upon the execution of machine readable game code (i.e. software). Of course, the processor 42 could also be pre-programmed or configured as hardware configured to generate such game data.

In one embodiment, the gaming device 26 includes means for storing game code or instructions. Such means may comprise one or more memory devices 44. Such might comprise RAM, ROM (including EPROM, EEPROM, PROM) or other devices now known or later developed. The gaming device 26 might include one or more other memory device 46, such as for storing game state information or the like, as detailed below.

Preferably, the gaming device 26 includes at least one random number generator (RNG) (whether configured as software or hardware) or other similar device. Such a generator is preferably utilized as part of the game code to generate random game outcomes. Such components/features are well known to those of skill in the gaming art.

The gaming device 26 preferably also comprises at least one communication device or interface to permit data to be provided to the gaming device 26 and to permit data to be transmitted from the gaming device 26 to one or more remote device 26. Such might comprise a communication interface 48. Once again, the configuration of the communication interface 48 might depend upon the particular type of communications to be utilized (wired or wireless) and the protocols.

In one embodiment, the gaming device 26 comprises at least one connector 50 or interface which both provides power to the gaming device and also serves as a communication pathway. Such connectors 50 may comprise pins, sockets or other elements for establishing a signal pathway to another device (such as one or more ports of a rack, as described below).

Notably, the gaming device 26 of the invention comprises a physical device. At the same time, the gaming device 26 does not include components which are found in standard gaming machines including: a coin, bill, ticket or other "value" acceptor; a coin, bill, ticket or other "value" dispenser; a coin, bill, ticket or other "value" storage device (such as a coin hopper or cash box); a display device (such as a video display or spinning reels); or player input devices (such as buttons, a handle or the like).

Figure 3:
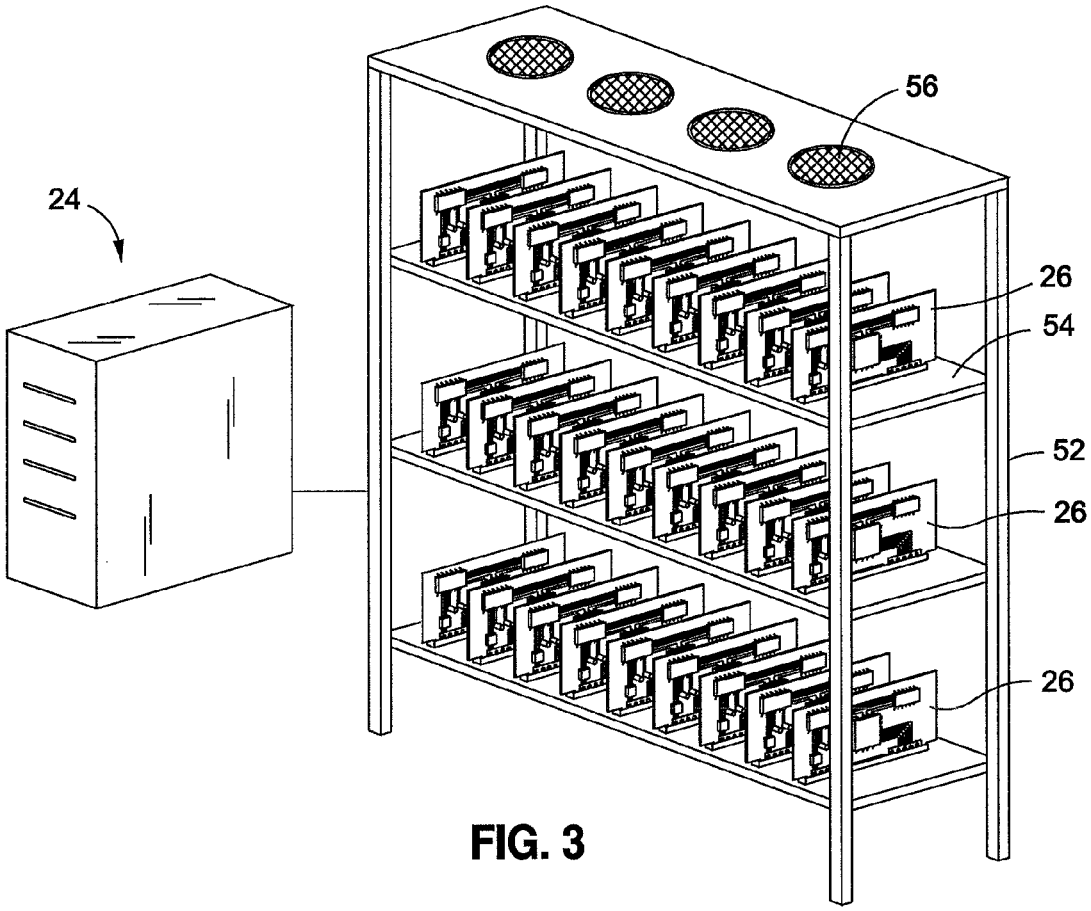
FIG. 3 illustrates an embodiment of a gaming device of the invention.

In a preferred embodiment, as illustrated in FIG. 3, the gaming system 20 comprises a plurality of gaming devices 26. Each gaming device 26 is configured to communicate with at least one gateway 24. In one embodiment, for example, a plurality of gaming devices 26, such as 100 gaming devices, might be associated with a single gateway 24.

In one embodiment, the gaming devices 26 may be mounted in one or more racks 52. Each rack 52 preferably comprises a support structure. The rack 52 might comprise, for example, a steel frame having one or more horizontal and vertical supports.

Each rack 52 may support one or more interfaces 54. The interfaces 54 may define a plurality of slots or ports for accepting therein the connectors 50 of each gaming device 26. The interfaces 54 may thus define a plurality of intermediate communication pathways between the gateway 24 and each slot (to thereby link a gaming device 26 located in the slot with the gateway 24) and intermediate power pathways between one or more power supplies and each slot (to thereby power a gaming device 26 located in a slot).

The rack 52 may include various other features. For example, the rack 52 may further comprise one or more cooling devices 56 such as fans or the like. The rack 52 might further comprise a plurality of power supplies, power cleaning devices (surge protectors, wave reformers and the like) and other devices and features configured to protect the gaming devices 26 and facilitate operation of the gaming devices 26.

In other embodiments, the gaming devices 26 might be located in one or more enclosures. For example, the gaming devices 26 could be mounted in a generally enclosed housing or cabinet. Such might be utilized to protect the gaming devices 26 from the environment, such as dust and other contamination, and to also locate the gaming devices 26 in a controlled atmosphere, such as a temperature controlled environment.

The rack 52 or other gaming device 26 mount might include other features. For example, the gaming devices 26 interfaces might include status indicators, such as lights to indicate whether the gaming device 26 is in a fault mode or otherwise inoperable, to indicate a normal operating condition, to indicate a relative rate of current data exchange or to indicate other conditions.

Additional details of the invention will now be described with reference to FIG. 4. In accordance with the invention, each gaming device 26 is dedicated to a specific player and can only be accessed by that designated player.

In one embodiment, each gaming device 26 is uniquely identifiable, such as by a unique serial or other identification number, port or other location. As described in greater detail below, each gaming device 26 is assigned to a particular player or entity, whereby only that player or entity can interface with the gaming device 26 and play games presented by that gaming device 26.

Figure 4:
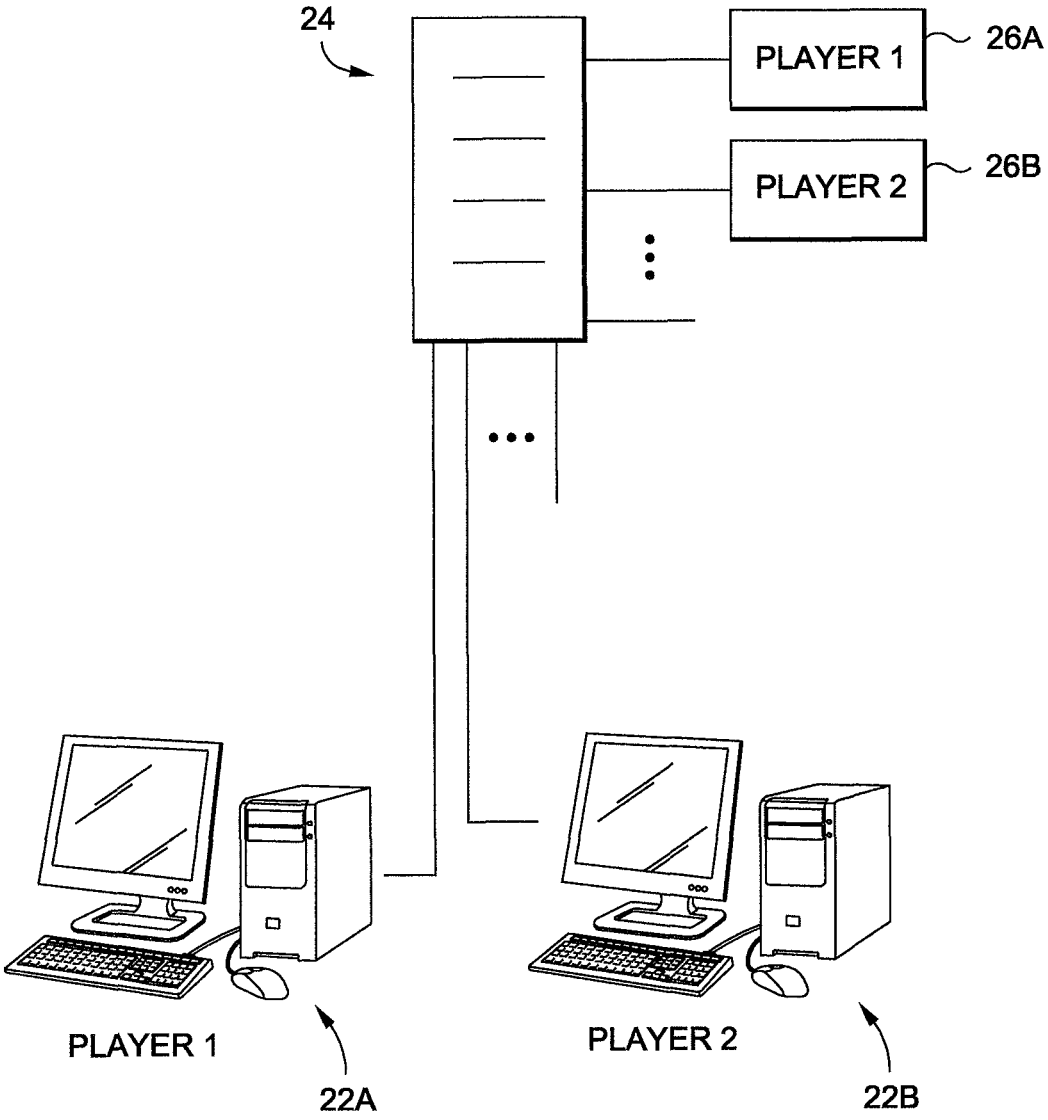
FIG. 4 illustrates the linking of different players via their presentation devices to player assigned gaming devices using a system of the invention.

Thus, as illustrated in FIG. 4, a first player 1 may have a first gaming device 26A assigned or registered to them. A second player 2 may have a second gaming device 26B assigned or registered to them.

The first player 1 might access their assigned gaming device 26A via first presentation device 22A, such as their home desktop computer. As described in greater detail below, the first player may contact the gateway 24 and, subject to identity verification, be placed in communication with their assigned gaming device 26A.

Likewise, second player 2 might access their assigned gaming device 26B via a second presentation device 22B, such as their laptop computer. The second player may contact the gateway 24 and, again subject to identity verification, be placed in communication with their assigned gaming device 26B.

As indicated above and as illustrated in FIG. 2, numerous gaming devices 26 may be provided, wherein each gaming device 26 is assigned or registered to a particular player or entity. Further, the one or more gateways 24 may permit a number of players to access their assigned gaming devices 26. For example, a casino might have 1000 gaming devices 26, such as located in racks in a secure gaming room. The casino might provide as few as one or multiple gateways 24, thus permitting up to 1000 players each access their assigned gaming device 26 at the same or different times.

Figure 5:
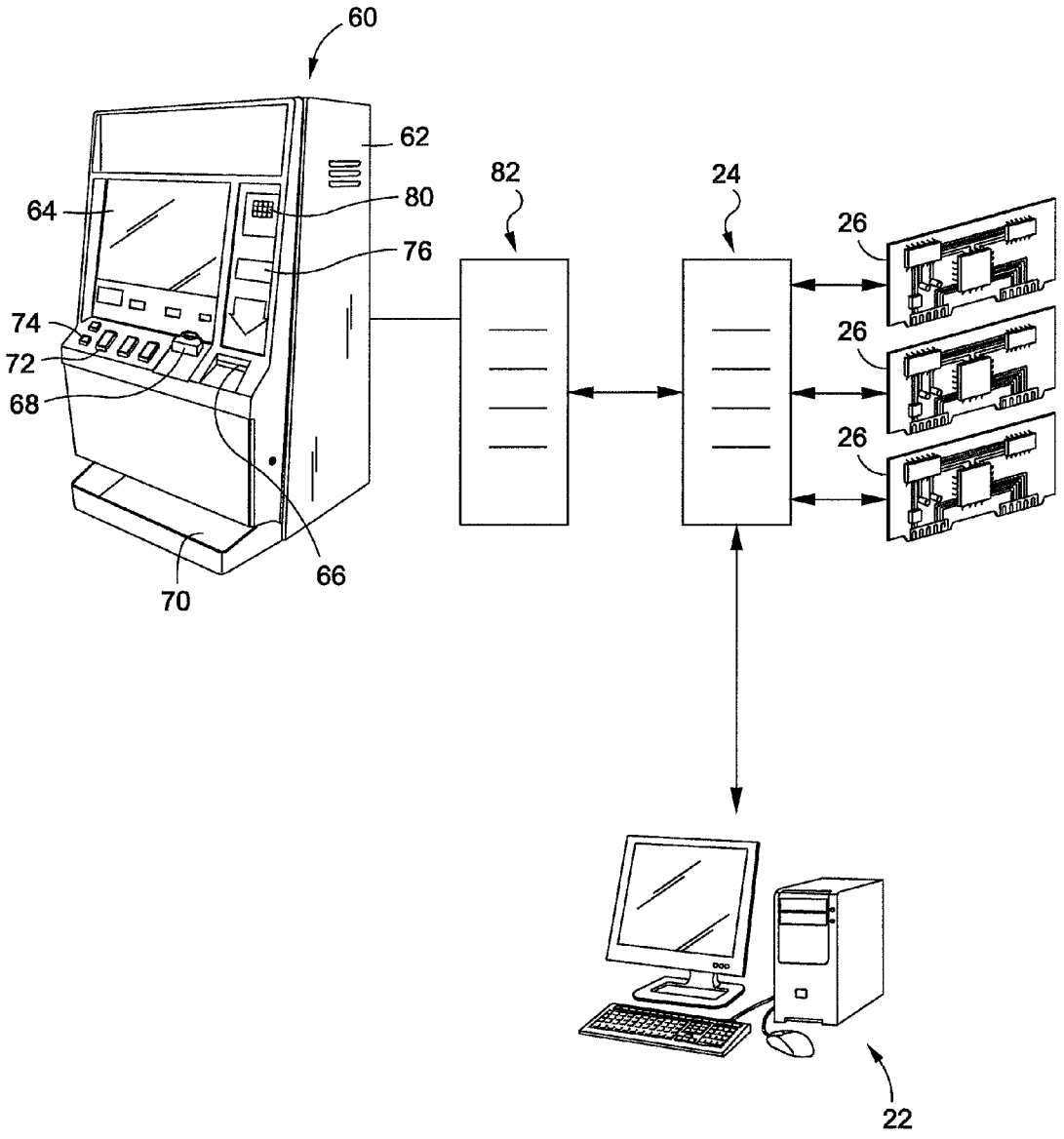
FIG. 5 illustrates the linking of a system of the invention with other components such as existing gaming machines and casino systems.

As illustrated in FIG. 5, a gaming system 20 of the invention may include or link to other systems and components. For example, a casino or other game provider may have a plurality of traditional gaming machines 60 on a gaming floor. Such traditional gaming machines 60 may have a plurality of features. For example, such a traditional gaming machine 60 may include a housing or cabinet 62 for enclosing/supporting various components of the gaming machine. The housing 62 may have a variety of configurations. In one embodiment, as illustrated, the housing 62 is configured so that the machine has an "upright" configuration. The traditional gaming machine 60 might also be configured as a "slant"-type, "bar-top" or have other forms.

In one embodiment, the traditional gaming machine 60 may be configured as a "video" type gaming machine, the machine including at least one display 64 for displaying game information to a player. The traditional gaming machine 60 may include other means for providing information to a player. For example, speakers (not shown) or other devices may be provided for generating sound associated with the game. The traditional gaming machine 60 may also include lights, printed instructions and other displays/display devices.

The games presented by the gaming machine(s) may be wagering type games wherein a player must place a bet or wager in order to play the game for the opportunity to receive winnings. Preferably, if the player is a winner of the game, the player is provided an award, such as a monetary payout (such as coins), credits representing monetary value, points or tangible prizes. As illustrated, the traditional gaming machine 60 thus includes a bill validator/acceptor 66 for accepting paper currency and a coin acceptor 68 for accepting coins. Other means of payment, such as a credit card reader, may be provided. An award of winnings in the form of coins may be paid to the player via a coin tray 70.

Preferably, the traditional gaming machine 60 includes means for a player to provide input. In one embodiment, this means comprises one or more buttons. For example, a "spin" button 72 may be provided for permitting a player to start a game. One or more wager buttons 74 may be provided for a player to select the amount to bet on a particular game. Other means of input may be provided, such as a touch-screen display and other devices now known or later developed.

A game controller (not shown) is provided for controlling the various devices of the gaming machine and for generating game information. For example, the game controller may be arranged to generate video and audio data for presentation by the display and speakers of the traditional gaming machine 60. The game controller may be arranged to detect a signal from the coin acceptor indicating the receipt of coins or from the bill validator regarding accepted bills and for registering credits corresponding to those inputs, for subtracting credits for wagers placed by a player, and for causing a coin delivery mechanism to deliver coins from a coin hopper to the coin tray 70 for payment of winnings and/or return to a player of unwagered credits. Preferably, the one or more player input devices provide an output to the gaming controller for use in play of the game. For example, in response to a "bet one" input by a player, the gaming controller is preferably transmitted a signal which causes the gaming controller to initiate presentation of the game.

The gaming machine 60 may include one or more random number generators for generating random game events and results. As indicated above, such a random number generator might be utilized to generate the game symbols for the positions of a matrix, be utilized to generate the base symbols, and be utilized to select award values for each symbol position, among other things.

As indicated, in one embodiment, game information is displayed by a video display 64 to a player. That display may be of a variety of types, including CRT, LCD, plasma and others. The gaming machine 60 may also include more than one video display.

In another embodiment, the traditional gaming machine 60 may include one or more physical reels capable of displaying symbols. In such a configuration, means are provided for rotating the physical reels. In one or more embodiments, the means may comprise a mechanical linkage associated with a spin arm, with movement of the spin arm (a "pull") by a user causing the reels to spin. In such an arrangement, the reels are generally allowed to free-wheel and then stop. In another embodiment, electronically controlled mechanisms are arranged to rotate and stop each reel. Such mechanisms are well known to those of skill in the art. In this arrangement, actuation of the spin arm or depression a spin button causes a controller (not shown) to signal the activation of the spin mechanism associated with one or more of the reels. Preferably, the controller is arranged to either turn off the signal to the device(s) effecting the rotation of each or all of the reels or generates a signal for activating a braking device, whereby the reels are stopped. As is well known, the combinations of reel positions and their odds of hitting are associated with the controller, and the controller is arranged to stop the reels in a position displaying a combination of indicia as determined by the controller based on the combinations and odds. The principal of such an arrangement is described in U.S. Pat. No. 4,448,419 to Telnaes, which is incorporated herein by reference. For example, the base symbols might be associated with spinning reels. Sets of base symbols might be generated by spinning those reels.

Such traditional gaming machines 60 may have other configurations, including other features. For example, the traditional gaming machine 60 may include a player tracking device, such as a card reader 78 and associated keypad 80. Such player tracking devices are well known and may permit the game operator to track play of players of the gaming machine. The tracked play may be utilized to offer player bonuses or awards.

In one embodiment, the traditional gaming machine 60 may be configured to dispense media, such as printed paper tickets, which have associated value. For example, winnings or unused credits may be returned to the player via a printed ticket having value or associated value. In one embodiment, the gaming machine 60 might also be configured to accept such media for providing credit for game play. Such systems are well known and thus not described in detail herein.

A casino may have numerous such gaming machines 60, such as located on a casino floor or in other locations. Of course, such gaming machines 60 might be used in other environments, such as an airport, a bar or tavern or other locations.

As indicated, the one or more traditional gaming machines 60 may be linked to other devices, such as one or more servers 82 or other systems of a casino or game provider. Such one or more servers 82 might comprise an accounting server/system, a ticketing server/system, a player tracking server/system, a game server/system or the like. For example, the one or more servers 82 might be used to generate ticket information to permit a traditional gaming machine 60 to dispense a value cash-out ticket, or to verify such a ticket which is presented at one of the traditional gaming machines 60.

As another example, the one or more servers 82 might track player play. For example, a casino or other game provider may have a player loyalty club. Each player may be uniquely identified and information regarding the player, including their game play, may be stored in one or more data files. Based upon a player's play, such as amounts wagered, lost, won, time of play or various other criteria, a casino may award a player bonus or free play, free or reduced cost goods or services (such as a casino jacket, a dinner at a casino restaurant, etc.).

In one embodiment, the gaming devices 26 or the one or more gateways 24, may be in communication with such secondary or other servers 82. For example, as detailed below, a player may be a member of a casino's loyalty club. When the player plays traditional gaming machines 60 offered by the casino, the player's play of games at those traditional gaming machines may be tracked. In addition, when the same player accesses and plays games via their assigned gaming device 26, that play may also be tracked (either separately or aggregated with the play of the one or more traditional gaming devices).

In one embodiment, the gaming machine 60 may be configured to present one or more game. In another embodiment, a player may play games presented by a gaming device 26 via a gaming machine 60, where the gaming machine 60 essentially acts only as a presentation platform or device.

Of course, the gaming devices 26 and/or one or more gateways 24 may be in communication with or otherwise link to other devices and systems.

Various aspects of the invention comprise methods of presenting and playing wagering games. Aspects of such methods will now be described with additional reference to FIGS. 6A and 6B. In one or more embodiments, such methods may be implemented by the devices and/or systems as described above and illustrated in FIGS. 1-5, though the methods might be implemented in other environments and/or via other devices or systems.

As one aspect of the invention, a gaming device is assigned or registered to a particular player or entity, whereby that player or entity is the only player or entity which can access that gaming device and play games presented by that device. As illustrated in FIG. 6A, in one method, in a step S1, a player or other entity is registered. This may comprise obtaining information which identifies the player, such as their name, address, social security number, telephone number, email address or the like. Such a registration may be the same as the registration process for joining the casino's existing loyalty club. As such, in some embodiments, the first step S1 may be accomplished as part of a player's earlier or existing registration with such a club.

In one embodiment, one or more data files may be generated and data may be stored with those files. For example, a data file may be generated relative to the player and the player identification information may be stored in the file.

In a step S2, a gaming device 26 is assigned to the player. As indicated above, such a gaming device 26 might be identified by its port or serial number. Preferably, each gaming device 26 is assigned to only one player. Thus, as part of this step, the method may include determining which gaming devices 26 are unassigned and available for assignment.

In one embodiment, information regarding the gaming device 26 is associated with the player. For example, the serial number of the assigned gaming device 26 may be linked to the player's information.

In a step S3, a login or other access information may be provided to or associated with the player. For example, a player may be assigned a User ID and/or an access password, or the player might be permitted to select such (of course, criteria for the User ID and password, such as the format thereof, such be selected by the game operator and the User ID and password may be subject to clearance, such as to ensure that different players do not select the same information). As indicated below, such information may be used by a player to identify themselves and access their assigned gaming device 26.

As indicated above, such information may be stored in one or more data files, tables or the like. FIG. 6C illustrates one exemplary data table. Such a table might be stored, for example, at the one or more gateways 24, one or more data storage devices associated with the one or more gateways, or other devices, such as a player tracking server 82 (see FIG. 5).

In the example illustrated, the data table includes fields which identify the player's name, their assigned or selected User ID, their assigned or selected password, and the serial number for the gaming device which is assigned to them. Of course, the data table might include other or additional information. Further, other or additional information might be stored other files or tables, including linked to the illustrated table. For example, another data table or file may store the player's identifying information, such as the physical address, telephone number, email address, etc. for the player whose name is listed in the illustrated table.

It will be appreciated that the above-referenced method may be implemented in various manners. For example, a player could fill out a physical registration form (such as using a pencil/pen) and submit the form to a game provider, such as at a player loyalty club desk. The operator might then key, scan or otherwise input required or important data into the system. In another embodiment, the registration process might be accomplished through a kiosk or access terminal at a casino or similar location, which kiosk or access terminal is linked to the gaming system. In yet another embodiment, the registration process might be accomplished by a player's presentation device 22. For example, a player might utilize a desktop computer to access a website of the casino on the Internet. The casino's website might have a registration utility which causes a graphical user interface or the like to be displayed upon the player's computer and via which the registration process may be completed.

The player identity information may also comprise other than a User ID and password. For example, a player might uniquely identify themselves via an encryption key, a fingerprint, retina scan or other types of information.

As one aspect of the invention, a player may access a unique gaming device 26 which has been assigned to them and, via that gaming device 26, play one or more wagering games. In a preferred embodiment, the method permits a player to access their gaming device 26 via a presentation device 22, and have one or more games presented by the gaming device 26 at their presentation device. As indicated herein, such a presentation device 22 might comprise a computer, cell phone, or even a casino gaming machine 60.

In accordance with one embodiment of a method, referred to FIG. 6B, a player provides access or login information. Preferably, such comprises the player providing information which identifies the player, as in a step S4. In one embodiment, this may comprise the player's User ID and password.

This step may be accomplished in various ways. For example, a casino may provide a website on the Internet. The player may access that website via their presentation device 22. The website may include a link, such as "Game Play Login" link. Upon clicking that link, a page or interface may be displayed to the player which requests their login information (such as providing a box or field for the player to input their User ID and another box or field into which the player may insert their password).

In a step S5, the player's identification or login information is verified. This may comprise, for example, comparing the user's User ID and password to those stored in the one or more data files. If no match is found, the player may be notified of such and the login process may either be terminated or the player may be requested to re-input their information again for verification, as in step S6.

In a step S7, if the player's identification is verified, the player is linked to their assigned gaming device 26. For example, if the player "Rocco Tarantino" has correctly identified himself with the appropriate User ID and password shown in the table in FIG. 6C, then he may be linked to his gaming device 26 which is identified with the serial number 2XF7114GK21. In one embodiment, referring to FIG. 1, this linking comprises placing the player's presentation device 22 in communication with their assigned gaming device 26 via the one or more gateways 24.

Once the player is linked to their unique assigned gaming device 26, the gaming device may present, and the player may play, one or more games as in step S8. As indicated herein, this may comprise the gaming device generating game information, including data representing video images. This data is transmitted from the gaming device 26 to the player's presentation device 22, such as through the gateway 24.

Of course, various games may be presented to the player. In one embodiment, when a player is linked to their gaming device 26, the gaming device may cause a graphical user interface to be displayed by the player's presentation device 22. That interface may permit the player to select different games for play, change play options or engage in other activities. For example, the player might be permitted to pick from a suite of different video slot games and/or video poker, keno, bingo or other games now known or later developed.

A player may provide input, such as via a touch screen of their presentation device 22, of a particular game to be played. This input is transmitted through the gateway 24 to the gaming device 26. At that time, the gaming device 26 begins the game, including by transmitting game information back through the gateway 24 to the player's presentation device 22. Such game information may comprise, for example, a video game display which illustrates images of slot reels and other information, cards or the like (depending on the game being presented).

Depending on the game being presented, the player may be required to provide various inputs and various information may be displayed to the player. For example, in a game of video poker, the player may be shown a set of dealt cards and then select one or more or all of the cards to be held and/or discarded.

As indicated herein, one or more of the games which are presented to the player are preferably wagering games in which a player places a wager and has the chance to win winnings. In one embodiment, the player provides value which is represented by one or more credits and has the opportunity to win credits or monetary wins represented by credits.

In one embodiment, the player may be required to deposit monies with the game provider, such as into an account which is associated with the player. For example, the player might deposit cash or provide a credit or debit card which is used to transfer an amount of funds, such as $500.00, to the player's account. Those funds may be represented by credits, such as 2000 credits where each credit has a value of $0.25, or 500 credits each having a value of $1.00.

In other embodiments, the player might provide value when the game is to be played. For example, the gaming device 26 might prompt the player to provide value account information, such as information regarding a credit or debit card. The player might provide such information via their presentation device 22. The gateway 24 might transfer such information to one or more external servers 82, such as an accounting server. The accounting server may communicate with a banking system or the like to affect a transfer of funds from the player's bank or credit account to an account belonging to the game provider.

In an embodiment where the player has an established account, the player may provide casino account information. In other embodiments, the player might store debit or credit card or bank account information in association with their player profile and such information may be automatically used to fund wagers.

In one embodiment, a player may then make a selection of the amount to wager as part of the play of a game. In one embodiment, a player may even be permitted to select the wager denomination for the game. For example, a game may require that the player place a minimum wager of 1 credit up to a maximum wager of 5 credits. However, the player may be permitted to select the denomination of each credit, such as $0.01, $0.05, $0.10, $0.25, $1.00 or other values.

Once the player made their wager selection, the wagered value may be deducted from their casino account, bank account or the like or may be charged to their credit card. In one embodiment, once the wager has been verified (such as by a signal from the accounting server to the gateway and on to the gaming device), the gaming device may present the game.

As indicated, one or more (but preferably not all) of the possible outcomes of the game may be designated as winning outcomes. One or more of the winning outcomes may have an associated award, such as an award of one or more credits. The number of credits for particular winning outcomes may vary, such as defined by a pay table for the game.

If a player receives a winning outcome having an associated award, the player is preferably credited with such an award, such as the number of credits. The credits may be credited to the player's casino account, for example. In other embodiments, the credits may be aggregated during game play and at one or more times the player may elect to "cash out" by having the monetary value represented by those credits be transferred to the player's bank account.

Various additional aspects of the invention will now be described, including advantages thereof. In accordance with the invention, specific gaming devices are associated or assigned to specific players. In this manner, only a single player can play a gaming device. This arrangement has a number of advantages.

First, as indicated above, many players do not like other players to play the gaming machine they wish to play. In accordance with the invention, the gaming device can only be played by the assigned player. This is true even during the times the player is not playing the gaming device.

Of course, in traditional game play while a player is playing a traditional gaming machine that player is the only one that can play the machine. However, once the player is done playing (such as when the leave the gaming machine), another player may then begin play of that same gaming machine. In accordance with the invention, this is not possible. In particular, only the assigned player can ever link to their assigned gaming device. For example, if a first player ceases game play of their assigned gaming device, another player cannot play the first player's assigned gaming device because no other player can access or log into that gaming device (other players are only able to log into their own uniquely assigned gaming devices).

The configuration of the invention also has advantages over server based games. In particular, as indicated above, each gaming device 26 is configured to independently generate its own games/outcomes. Thus, each player's play of their own gaming device is not affected by any other player's play of their assigned gaming device. This is unlike server based gaming in which a server having a random number generator may generate multiple game outcomes for a plurality of players. Many players do not like server based gaming for the same reason as traditional gaming machines: the involvement of other players and outcomes which are perceived to change their odds of receiving a winning outcome. Again, in accordance with the present invention, each assigned gaming device generates its own outcomes only for its assigned players. In this manner, no outcomes are generated or received by any other players relative to a single one of the gaming devices.

This feature of the invention also has a number of other advantages. For example, the status or game state of play relative to a player's gaming device is always maintained by the gaming device. As indicated in the Background herein, a player of a traditional gaming device might play a number of games and increase a progressive jackpot to a large value. However, once the player stops playing, another player might play the same gaming machine and after one or two games trigger the jackpot and win the winnings that were substantially grown by the previous player's play.

In accordance with the invention, no player(s) other than the assigned player can play their gaming device. Thus, only the player can reap the rewards of playing that device. This further means that different game states do not need to be maintained for different players or the like. For example, a certain game may allow a player to collect bonus symbols. A player may have collected 22 of the required 25 symbols needed to win a bonus. In accordance with the invention, that information is stored at or in conjunction with the player's assigned gaming device. Thus, the player may cease play at any time and then later resume play at the exact same point (and because no other intervening players may play that gaming device, no other game state information or the like needs to be saved nor can another player's play interfere with or take advantage of the assigned player's level or state of play).

In one embodiment of the invention it is contemplated that the gaming devices 26 may comprise relatively low cost computer boards. In this manner, a gaming device 26 may be manufactured and before ever being used, be assigned to a player. Preferably, once assigned to a player, the gaming device is never assigned to another player. For example, if a player wishes to permanently cease game play of their assigned gaming device, the casino or operator may destroy the gaming device 26 and replace it with a new one (which may be assigned to the same player or a different player).

In one embodiment, a player may be required to meet certain criteria in order to be entitled to be assigned a gaming device. For example, a player might be required to pay a fee, such as a "game purchase" or reservation fee. In other embodiments, a casino might offer such a feature to players who meet certain thresholds of game play of traditional gaming machines at the casino, as a promotion or the like.

Another particular advantage of the invention is that the system and method permit a player to play wagering games remotely, such as from a remote home or office computer or other device such as a portable PDA. This also has the advantage that a casino can offer game play to remote players without tying up traditional gaming machines on the floor of the casino. Thus, a casino may have 500 traditional gaming machines on their casino floor and thus serve up to 500 players via those machines. In addition, the casino might have 1000 gaming devices of the present invention, thus permitting up to an addition 1000 assigned players to play those devices at the same time as the 500 players of the traditional gaming machines.

Another aspect of the invention is that a player at a casino might play either traditional gaming machines or their assigned gaming device. For example, a player might travel to a casino and play one or more traditional gaming devices. If the player wishes to stop play of such gaming machines to, for example, eat dinner, the player might access their gaming device via their PDA and play one or more wagering games while they eat dinner. Further, as detailed herein, it may be possible for a player to utilize an existing gaming machine 60 as a presentation device, wherein the games presented at the gaming machine 60 are actually generated by or through a gaming device 26.

As indicated above, a player's play of their gaming device 26 may also be tracked, either separately from or in aggregated fashion with their play of traditional gaming machines. In this manner, a player's play of their gaming device 26 may be tracked so as to yield player loyalty rewards or the like. For example, a player who achieves certain criteria of play (such as amounts wagered, number of games played, number of losing outcomes, etc.) might be awarded free game play or free or reduced cost goods or services. As indicated above, such functions might be implemented by a player tracking server 82 which is provided game play information via the gateway 24.

In one embodiment, other features may be implemented relative to the gaming devices 26. For example, though each gaming device 26 is entirely independent, the gateway 24 or a bonus server 82 or the like might implement a system-wide progressive jackpot. For example, a bonus server 82 may be linked to the gaming devices 26 via the one or more gateways 24. If any player of their assigned gaming device 26 achieves a particular outcome, the bonus server 82 might cause that player to be awarded a bonus or progressive jackpot.

In one embodiment, the method and system may include means for verifying the eligibility of a player for play of their gaming device 26. Currently, many jurisdictions (such as states) do not allow wager-based gaming. Thus, if a player is located in such a jurisdiction, the player may not be permitted to play a gaming device, even if the gaming device is itself located in a jurisdiction in which gaming is legal.

In one embodiment, location information may be transmitted from the player's presentation device 22 to the gateway 24 for verification by the gateway or an associated device/system. For example, when a player is utilizing a computing device to access the gateway 24 via the Internet, the player's location might be determined from the IP address of the user's presentation device 22. If the player accesses the gateway via a PDA or cell phone, the player's location may be determined by the location of the device as determined by the cellular phone network.

In one embodiment, a player may be assigned a cellular network card for their computing device. That card may interface with the cellular network to obtain location information. That location information may be transmitted via the player's computer over a computer network, such as the Internet.

In other embodiment, GPS devices may be utilized to determine the player's location. The GPS location information may be transmitted to the gateway 24.

Another embodiment of the invention comprises gaming machines, devices and/or a gaming system which utilize player-assigned random number generators. In particular, a unique random number generator is assigned to a single player. That random number generator is used to determine the outcome of the games played only by the assigned player. In accordance with yet another embodiment of the invention, an RNG may be stopped or paused and then restarted, such as relating to a stopping and re-starting of game play.

In one embodiment, each gaming device 26 of the invention may include or implement one or more RNGs. In another embodiment, the gaming devices 26 may communicate with an RNG device, such as an RNG server 82 which includes or implements one or more RNGs and which is separate from the gaming devices 26.

Each RNG preferably comprises a device or program code implemented at a device, the RNG configured to generate random numbers or other random data or values. For example, an RNG may initiate with a seed value and generate a sequence of random numbers. The RNG may be configured to generate numbers in a certain range or ranges. For example, in the case of a card game where cards from a 52 card deck are utilized, the RNG may be configured to generate numerical values between 1 and 52 corresponding to cards in the deck. These values may be used to determine aspects of the game or game outcome.

In a preferred embodiment, each gaming device 26 includes or implements one or more RNGs and/or the RNG server 82 comprises multiple RNGs, wherein each RNG is uniquely assigned to a specific player. In one embodiment, each gaming device 26 may implement or include its own RNG. Thus, when such gaming devices 26 are uniquely assigned to a player, the RNG of that gaming device is thus uniquely assigned to that player. In this manner, each player's game outcomes are generated from their own assigned RNG by virtue of their play of their assigned gaming device 26.

In another embodiment, an RNG server may be configured to implement a plurality of different RNGs. Each RNG may comprise, for example, the separate execution of an instance of software code comprising an RNG. The RNGs could also comprise hardware, such as individual microprocessors. Each RNG is assigned or associated with a single player. For example, the RNG server may be configured to implement RNG1, RNG2, RNG3 . . . RNGn. A first player P1 may be assigned to RNG1, a second player P2 may be assigned to RNG2 and so on.

In such an embodiment, the player's assigned RNG is used to determine game outcomes of games presented to the player and played by the player at their gaming device 26. For example, in one embodiment of the invention, player P1 may wish to play their gaming device 26A as illustrated in FIG. 4. The player may login to or access their assigned gaming device as described above, whereby they are linked to their gaming device 26A. Using information regarding the player's assigned RNG, such as stored at the gaming device 26A or the gateway 24, the gaming device 26A preferably links to the player's assigned RNG1 at the RNG server.

For example, the gaming device 26A may be configured to present a video poker game. The gaming device 26A may communicate with the RNG server to obtain one or more random numbers from RNG1 for use in determining the outcome of the game presented to player P1. This sequence of numbers might be used to determine the identity of cards which are dealt to a player, for example (the sequence of cards thus determining the outcome of the poker hand of the player).

In a preferred embodiment, RNGs are uniquely assigned. Thus, a second player P2 may wish to play their gaming device 26B. Player P2 may access their assigned gaming device 26B and that gaming device 26B may access the player's assigned RNG2 at the RNG server, whereby random numbers from RNG2 are preferably used to determine the outcomes of the games presented by the gaming device 26 that player P2 is playing.

In accordance another aspect of the invention, an RNG which generates data, such as numerical values used to determine game outcomes, may preferably be stopped and restarted at one or more times. Preferably, the RNG is stopped at a particular point of a sequence of data and then later restarted from the next successive point. In one embodiment, this feature is applied to each player's assigned RNG.

As one example of the invention, an RNG may be represented by the following:

$$x(0)=\text{given},\ x_{n+1}=P_1x_n+P_2(\text{mod } N)\ n=0,1,2,\ldots\ (*),$$

wherein the notation mod N means that the expression on the right of the equation is divided by N, and then replaced with the remainder.

For a particular seed value x(0), this RNG will generate a sequence of numbers. For example, if x(0)=79, N=100, $P_1$=263, and $P_2$=71, then:

$$x(1)=79*263+71(\text{mod } 100)=20848(\text{mod } 100)=48,$$

$$x(2)=48*263+71(\text{mod } 100)=12695(\text{mod } 100)=95,$$

$$x(3)=95*263+71(\text{mod } 100)=25056(\text{mod } 100)=56,$$

$$x(4)=56*263+71(\text{mod } 100)=14799(\text{mod } 100)=99,$$

and x(n) continues with the values 8, 75, 96, 68, 36, 39, 28, 35, 76, 59, 88, 15, 16, 79, 48 (then repeating).

In accordance with the invention, this RNG might be started and generate the numbers 48, 95 and 56 to define the outcomes of three successive slot game outcomes (such as where each number represents the stopping position of a set of three physical reels, that stopping position corresponding to a particular set of displayed symbols, and thus a particular slot game outcome).

After three games, the player may wish to cease game play. At that point, the RNG may pause, go idle or the like. When the player wishes to again begin game play, the RNG preferably restarts at the point where the RNG left off. In this case, the next number generated by the RNG would be 99.

In particular, in accordance with a preferred embodiment of the invention, an RNG may be stopped or paused when a particular player ceases game play. The RNG may restart, preferably from the stopping or pausing point (preferably the next data point in the data sequence), when the player wishes to again begin game play.

The RNG may be stopped/paused and restarted based upon various criteria. For example, an RNG may start once a player identifies themselves and a gaming device "calls" for the first game data or outcome. The RNG may be paused or stopped when a player ceases game play in a session, such as by logging out from the gaming device, or the like, or when another player identifies themselves to begin a session. In one embodiment, the RNG might pause or stop when a predetermined period of game play inactivity occurs.

Various additional aspects of the invention and advantages thereof will now be described.

It will be appreciated that the configurations of the RNGs, such as the particular software which implements the RNG and thus the underlying 'math', may vary. In particular, individual RNGs may have various configurations now known or later developed.

It will also be appreciated that the individual RNG data may be used in various manners as is known in the art. For example, particular RNG data may be used to represent entire game outcomes, particular cards or card values, particular slot symbols or the like.

It will also be appreciated that the values which the one or more RNGs generate may vary. For example, the range of RNG values or how those values are utilized may vary. For example, an RNG may generate numerical values in the range of 1-99 or 1-999 or 1-9,999,999,999, 100-10,000, or various other ranges. As indicated, those vales may be used or "mapped" in various manners as part of presenting one or more games.

It will also be appreciated that while the RNGs of the invention preferably generate random data, in accordance with the art, such data may actually be relatively random or pseudo random and not truly random (for example, an RNG of the invention may generate a sequence of numbers which ultimately repeats or which, statistically does not cause each number in a range to be chosen in a statistically equal fashion).

In a preferred embodiment of the invention, an RNG is assigned to a particular player. Thus, numbers or "outcomes" generated by the RNG which are assigned to that player are not utilized in the play of games by other players. In a preferred embodiment, the RNG which is assigned to a particular player may be used in the presentation and play of games at or via two or more different devices or machines.

This feature has particular advantages over the prior art. In particular, in this arrangement each player's game outcomes are unique and separate. Thus, a first player P1 need not be concerned about stopping game play and leaving a "hot" gaming machine or the like, as described above in the background. In particular, in accordance with the invention, intervening play of such a gaming machine by one or more other players is independent from the sequence or flow of game outcomes for player P1 because the game outcomes for the other players are determined by one or more other RNGs. Thus, a player need not "reserve" a gaming machine or the like in order to protect a particular game flow.

In a further preferred embodiment of the invention, a RNG may be stopped and restarted. An RNG assigned to a particular player may thus be stopped when a player ceases game play and then restarted when the player resumes game play.

In one embodiment, during the time such an RNG is active (i.e. during the time is not stopped or paused), it may continuously generate data. Not all of that data may be used by a gaming machine. For example, during the time a game is being presented, such an RNG might generate hundreds or thousands of values. However, the gaming machine might "call" or use only a few of those values as the gaming machine requires values to play the game. In such a configuration, an RNG might be started and generate a large number of values, only some of which are used during a first gaming session. At the end of that session, the RNG might be stopped or paused. The RNG may then be restarted upon the initiation of a new gaming session, at which time the RNG may again generate values in a continuous manner, not all of which value may be used by the gaming machine during the second session.

In another embodiment, however, a sequence of numbers or game outcomes generate by an RNG might correlate to values needed or used by a gaming machine to present games, i.e. where the RNG generates values which are used in succession or sequentially by the gaming machine. In such a configuration, the RNG might generate a last value in a first gaming session, which last value is used as part of presenting a last game in that first gaming session. The RNG may then pause or stop. When game play resumes, the RNG may again begin generating values, preferably from the very next value in the sequence, and wherein each value generated thereafter in that second session is used sequentially by the gaming machine to present games in that second session (wherein each generated RNG value is used essentially sequentially by the gaming machine in the presentation of the games).

Relative to this configuration, the RNG data or values might be buffered. For example, upon the initiation of a player's RNG, the RNG might immediately generate a sequence of 100 values. If the player only plays a single game, only 20 of those values might be used. Even though the player's RNG may continue to run, the next instance of game play by that player may preferably begin with the $21^{st}$ data value in the sequence.

It will be appreciated that the RNG pause/restart feature may be applied to an RNG of a particular gaming device 26, or to the RNGs implemented by an RNG server. For example, as indicated above, each gaming device 26 may implement or include its own RNG. In that embodiment, the RNG of that particular gaming device 26 may be started, stopped and restarted, etc., as the player assigned to that RNG uses or accesses that gaming device. Alternatively, when the gaming device links to a remote RNG assigned to the player, that remote RNG (such as at the RNG server) may implement such a feature.

In accordance with another aspect of the invention, a gaming machine or device may be shared by two or more players. Preferably, a gaming machine or device may be timed-shared, including in a manner where the gaming machine is unique to each player.

In one embodiment of the invention, two or more players may access and play a gaming device 26 such as described above. As detailed below this feature may also be applied to a gaming machine 60, thus while this aspect of the invention is generally described relative to a gaming device, such is generally applicable to a gaming machine as well. While the two or more players might possibly access a gaming device at the same time, in a preferred embodiment, each player plays the gaming device at different times.

As one aspect of the invention, one or more players might reserve one or more time periods or intervals for play of a gaming device. During a reserved time, only the assigned player would be permitted to play the gaming machine. For example, player P1 might reserve the gaming device 26A illustrated in FIG. 4 during the time period of 1:00 pm to 9:00 pm on Saturday, Aug. 6, 2011. During that time, only player P1 would be permitted to play the gaming machine.

Access to a gaming device 26 might be controlled in various fashions. For example, a player P1 might make a reservation at a particular gaming device 26 or via an associated gaming system. As one example, a casino might operate a reservation website via a server. The website might include a graphical user interface by which players may make gaming machine reservations. The website might display, for example, a list of different gaming machines or gaming device and available time slots for reservation.

In one embodiment, a player may be required to identify themselves to place a reservation. Once the player has provided identification, the system may store the reservation along with the player's identification information. The system might lock the gaming device 26 from use by other players when the reserved time is reached.

A similar feature may be applied to a gaming machine 60, such as a gaming machine which is located on a casino floor. First, a reserved gaming machine 60 which is otherwise available for public access might display a reservation notice. This notice may indicate the time or times that gaming machine 60 is reserved and/or that the gaming machine 60 is currently unavailable for play because it is reserved.

In order for the player to access the gaming machine 60 or gaming device 26, the player may be required to identify themselves. For example, the player might provide identification information such as described above. Such might comprise a player tracking card or the like. Once the player's identity is confirmed against the reservation, then the gaming machine 60 or gaming device 26 may be unlocked for game play by that player. Of course, if another player attempted to play the gaming machine 60 or gaming device 26, their identification would not match the reservation and the gaming machine 60 or gaming device 26 would not permit game play.

In another embodiment, when a player makes a reservation they might simply be issued an access code or the like. The player might then access the gaming machine 60 or gaming device 26 during the reserved time by providing the access code. In this configuration, a player could reserve a gaming machine without, for example, being a member of a casino's player club or the like.

If a player makes a reservation using a credit or debit card or the like, as detailed below, the player might use that card to identify themselves at the gaming machine 60 or gaming device 26.

In one embodiment, a player might be required to pay for a reservation. The cost of a reservation might depend upon various factors including, but not limited to: the particular gaming machine or gaming device to be reserved (such as a very popular vs. less popular gaming machine), duration of the reservation and/or time of day the reservation. For example, a casino might charge a higher amount for a long duration reservation or for a reservation during peak game play times (such as Friday or Saturday evenings) vs. off-peak times (such as early mornings). Of course, a casino might offer discounts for bulk reservations, players who wager large amounts or the like. A player might be required to make payment for a reservation using monies deposited with the casino (such as from a player's account), via credit card, debit card or the like.

In some embodiments, a casino might offer a player a free reservation or upgraded or a lower cost reservation based upon the player's game play. For example, a player's high level of game play (total wagers during a period, total losses during a period or the like), such as determined by tracking the player's game play via a player tracking system or the like, might result in such awards to the player.

In accordance with this aspect of the invention, one or more players might reserve particular time periods or time slots for play of a particular gaming machine or gaming device. In this manner, the players may "time share" the gaming machine or gaming device. In one embodiment, during times when a gaming machine or gaming device is not reserved, a gaming machine or gaming device might be available for play by any player. Thus, for example, if a player's reservation ends, that player may continue to play unless or until another player's reservation goes into effect. For example, if a player P1's reservation lasts from 3-5 pm and a second player P2's reservation does not start until 6 pm, player P1 might continue to play the gaming machine during the "public" period from 5-6 pm. Of course, during a "public" or unreserved period, the player ceases game play and leaves the gaming machine, another player may freely access the gaming machine.

In accordance with a preferred embodiment of the invention, the time-share feature is enabled in a manner that a single gaming machine or gaming device is unique or dedicated to a player. In one embodiment, this feature is implemented by the player assigned RNG feature described herein. In particular, in a preferred embodiment, during a reserved time period, a player's play of a gaming machine or gaming device is implemented by the player's uniquely assigned RNG.

Figure 7:
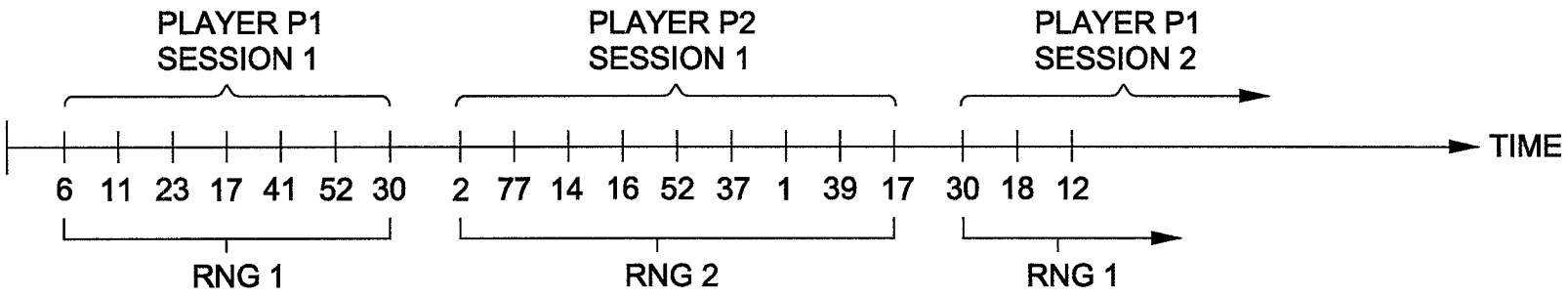
FIG. 7 illustrates operation of a method and system of the invention wherein RNGs are uniquely assigned to two different players and the two players time-share a gaming machine or device.

This concept may be appreciated from FIG. 7. As one example of the invention, player P1 might reserve a first gaming machine or gaming device GM1 during the time slot of 5-7 pm on a Saturday. During that time period or session, player P1 might play a number of games at the gaming machine or gaming device GM1. Preferably, the gaming machine or gaming device GM1 implements those games via the player's uniquely assigned RNG1.

A second player P2 might reserve the time slot 7-9 pm on the same Saturday. As a result of player P2s reservation following player P1's reservation, player P1 must stop game play at the gaming machine or gaming device GM1 at 7 pm. Player P2 may then access the same gaming machine GM1 during the time period of 7-9 pm. During that time or session, player P2 might play a number of games at the gaming machine or gaming device GM1. Preferably, the gaming machine GM1 implements those games via the player's uniquely assigned RNG2.

It will now be appreciated that the gaming machine or gaming device GM1 essentially acts as a dedicated or unique device to each player, even though it is being shared by two or more players. In particular, by using the RNG feature described herein, a player's play of a gaming machine is unique to that player (other players' play of the gaming machine does not impact or effect the game outcomes or the like to that player).

It will be appreciated that in the time-share and assigned RNG features of the invention may be applied to a gaming device 26 such as that described above in a manner that the gaming device 26 essentially becomes unique to a player, even though the gaming device 26 is being shared by two or more players. A particular aspect of this configuration of the invention is that a casino or other operator could utilize fewer numbers of gaming device 26 to service larger number of players than if each player has their own dedicated gaming device 26. Yet, however, the gaming devices 26 would behave and be configured as though they were dedicated or unique to each player via the time share and/or RNG features described herein.

Of course, this feature of the invention may be implemented in various manners. For example, a player might be prevented from making two or more reservations during the same time period (such as at two different gaming machines). A player might also be prevented from making excessive reservations, such as reservations totaling more than a certain aggregate time during a single day, during a week or other time period.

This feature of the invention may be applied to various gaming machines or devices. Such may include a gaming machine 60 or gaming device 26 such as described above, but may include other configurations of devices, including table-type games or the like. For example, a player might be permitted to reserve a spot at a multi-player gaming machine, device, table or other system.

It will be appreciated that the systems and methods of the invention may be implemented in various environments. For example, the systems and methods may be implemented at a traditional casino, as described above. The systems and methods might also be implemented via a tavern or other game operators, including route operators (such as airports, convenience stores or the like), or even via operators not having a traditional physical casino.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A gaming system comprising:

a plurality of casino gaming machines directly playable by one or more players, the casino gaming machines each comprising a housing, at least one display, at least one player input device and at least one processor, said at least one processor configured to implement at least one first random number generator and to generate primary game information based upon an output of said at least one first random number generator, to cause said primary game information to be displayed by said at least one display and to receive player input at one or more times via said at least one player input device, whereby said casino gaming machines are capable of presenting one or more primary games to players thereof;

a plurality of game boards, each game board comprising at least one processor configured to generate secondary wagering game information, the plurality of game boards being communicatively coupled to the plurality of casino gaming machines; wherein said plurality of casino gaming machines are further configured to present one or more secondary wagering games based upon said secondary wagering game information generated by said plurality of game boards.

2. The gaming system according to claim 1, wherein a first game board of the plurality of game boards is assigned to a first player such that when the first player plays a first casino gaming machine of the plurality of casino gaming machines, the first gaming machine receives secondary wagering game information generated by the first game board, and when the first player plays a second casino gaming machine of the plurality of casino gaming machine, the second gaming machine receives secondary wagering game information generated by the first game board.

3. The gaming system according to claim 1, further comprising at least one gateway configured to link the plurality of casino gaming machines with the plurality of game boards.

4. The gaming system according to claim 1, wherein the secondary wagering game information comprises data generated by at least one second random number generator.

5. The gaming system according to claim 4, wherein the data generated by the at least one second random number generator is buffered to create a sequence of a predetermined amount of values.

6. The gaming system according to claim 1, wherein the plurality of game boards are located remotely from said casino gaming machines.

7. The gaming system according to claim 1, wherein the plurality of game boards are not directly playable by a player.

8. A gaming system comprising:

a plurality of casino gaming machines, the casino gaming machines each comprising a housing, at least one display, at least one player input device, and at least one processor, the plurality of casino gaming machines being directly playable by one or more players;

a plurality of game boards, each game board comprising at least one processor configured to generate wagering game information, the plurality of game boards being communicatively coupled to the plurality of casino gaming machines but not configured to be directly playable by a player; wherein game outcomes of one or more games presented by one of the plurality of casino gaming machines are based on the wagering game information generated by one of the plurality of game boards.

9. The gaming system according to claim 8, wherein a first game board of the plurality of game boards is assigned to a first player such that when the first player plays a first casino gaming machine of the plurality of casino gaming machines, the first gaming machine receives game information generated by the first game board, and when the first player plays a second casino gaming machine of the plurality of casino gaming machine, the second gaming machine receives game information generated by the first game board.

10. The gaming system according to claim 8, further comprising at least one gateway configured to link the plurality of casino gaming machines with the plurality of game boards.

11. The gaming system according to claim 8, wherein the wagering game information comprises data generated by at least one random number generator.

12. The gaming system according to claim 11, wherein the data generated by the at least one random number generator is buffered to create a sequence of a predetermined amount of values.

13. The gaming system according to claim 8 wherein said plurality of game boards are located remotely from said casino gaming machines.

* * * * *